US010774572B2

(12) United States Patent
Urano

(10) Patent No.: US 10,774,572 B2
(45) Date of Patent: Sep. 15, 2020

(54) OPENING-CLOSING BODY DRIVING DEVICE

(71) Applicant: Mitsuba Corporation, Gunma (JP)

(72) Inventor: Yoshitaka Urano, Gunma (JP)

(73) Assignee: Mitsuba Corporation, Kiryu-shi, Gunma (JP)

( * ) Notice: Subject to any disclaimer, the term of this patent is extended or adjusted under 35 U.S.C. 154(b) by 160 days.

(21) Appl. No.: 16/082,993

(22) PCT Filed: Jan. 26, 2017

(86) PCT No.: PCT/JP2017/002640

§ 371 (c)(1),
(2) Date: Sep. 7, 2018

(87) PCT Pub. No.: WO2017/154392

PCT Pub. Date: Sep. 14, 2017

(65) Prior Publication Data

US 2019/0093412 A1 Mar. 28, 2019

(30) Foreign Application Priority Data

Mar. 10, 2016 (JP) ..... 2016-046726

(51) Int. Cl.
*E05F 15/643* (2015.01)
*E05F 15/655* (2015.01)
*E05D 15/10* (2006.01)

(52) U.S. Cl.
CPC ..... *E05F 15/643* (2015.01); *E05F 15/655* (2015.01); *E05D 15/1047* (2013.01);
(Continued)

(58) Field of Classification Search
CPC ..... E05F 15/646; E05F 15/643; E05F 15/655; E05Y 2900/531; E05Y 2201/654;
(Continued)

(56) References Cited

U.S. PATENT DOCUMENTS 7,815,242 B2 * 10/2010 Yoshida ..... E05F 15/646 296/146.4
7,854,093 B2 * 12/2010 Yoshida ..... E05F 15/646 296/155

(Continued)

FOREIGN PATENT DOCUMENTS

JP 2011074657 A 4/2011
JP 2013007252 A 1/2013

OTHER PUBLICATIONS

International Search Report for PCT Serial No. PCT/JP2017/002640 dated Apr. 18, 2017.

*Primary Examiner* — Justin B Rephann
(74) *Attorney, Agent, or Firm* — McCormick, Paulding & Huber PLLC

(57) ABSTRACT

A cross-sectional shape of an open-side cable 22*a* is formed into a round shape, and a cross-sectional shape of respective connecting units 52 between a pulley groove 50 of a pulley 46 and flange portions 51 is formed into a circular arc shape. Thus, it is possible to surely suppress damage of the open-side cable 22*a* caused by being strongly pressed to a corner as a conventional manner. Therefore, it is possible to improve durability of the open-side cable 22*a*, whereby it is possible to extend a maintenance cycle of a driving unit and obtain high reliability thereof.

8 Claims, 12 Drawing Sheets

(52) U.S. Cl.
CPC ... *E05Y 2201/654* (2013.01); *E05Y 2201/664* (2013.01); *E05Y 2201/668* (2013.01); *E05Y 2201/672* (2013.01)

(58) Field of Classification Search
CPC ..... E05Y 2201/664; E05Y 2201/668; E05Y 2201/672
See application file for complete search history.

(56) References Cited

U.S. PATENT DOCUMENTS

| | | | | |
|---|---|---|---|---|
| 8,857,104 | B2 * | 10/2014 | Ishigaki | B60J 5/06 49/209 |
| 9,476,245 | B2 * | 10/2016 | Hansen | E05F 15/643 |
| 9,896,873 | B2 * | 2/2018 | Uchitsunemi | E05F 15/643 |
| 2004/0195419 | A1 * | 10/2004 | Yamagishi | E05F 15/646 242/365.6 |
| 2008/0036317 | A1 * | 2/2008 | Miyagawa | H02K 7/1004 310/83 |
| 2008/0178528 | A1 * | 7/2008 | Yoshida | E05F 15/646 49/332 |
| 2008/0179919 | A1 | 7/2008 | Yoshida et al. | |
| 2009/0019776 | A1 * | 1/2009 | Ohtaki | E05D 13/00 49/360 |
| 2013/0333290 | A1 * | 12/2013 | Ishigaki | B60J 5/06 49/349 |
| 2016/0348768 | A1 * | 12/2016 | Urano | E05F 15/646 |

* cited by examiner

OPENING-CLOSING BODY DRIVING DEVICE

CROSS-REFERENCE TO RELATED APPLICATION

This application is a National Stage application of International Patent Application No. PCT/JP2017/002640, filed on Jan. 26, 2017, which claims priority to Japanese Patent Application No. 2016-046726 filed on Mar. 10, 2016, each of which is hereby incorporated by reference in its entirety.

TECHNICAL FIELD

The present invention relates to an opening-closing body driving device that drive an opening-closing body for opening and closing an opening portion.

BACKGROUND ART

Heretofore, in a vehicle such as a minivan or an estate car (so-called one-box car), a sliding door (opening-closing body) that slides in a front-rear direction of the vehicle is provided on a side portion of a vehicle body. This allows getting on and off the vehicle or loading and unloading of a burden to be carried out easily from a large opening portion that is formed on the side portion of the vehicle body. Since weight of the sliding door is heavy, a power sliding door device capable of automatically opening and closing the sliding door is mounted on the vehicle.

In the power sliding door device, one end of a cable the other end of which is connected to the sliding door from a front-rear direction of the vehicle is introduced to a driving unit via inversion pulleys provided at both ends of a guide rail fixed to a vehicle body. The one end of the cable is wound around a drum of the driving unit. By rotating the drum by means of a motor, the sliding door is pulled by the cable to open and close the opening portion.

In the cable type power sliding door device as described above, the sliding door is guided by a curved portion of the guide rail and is drawn into the inside of the vehicle body by strong force. For this reason, the cable extends due to long-term usage, whereby a path length of the cable gets elongated. For example, in a driving unit described in Patent Document 1, in order to absorb change in the path length of a cable, a pair of tensioner mechanisms is provided in a case so as to correspond to open-side and close-side cables. This causes predetermined tension to be applied to each of the cables, thereby eliminating slack of each of the cables.

RELATED ART DOCUMENTS

Patent Documents

Patent Document 1: Japanese Patent Application Publication No. 2011-074657

SUMMARY

In the driving unit described in Patent Document 1, a flat roller is adopted as a pulley constituting the tensioner mechanism. Specifically, a cylindrical guide surface (flat surface) is provided on an outer periphery of the pulley, and flange portions are respectively formed at both sides thereof in an axial direction in order to prevent the cable to drop off from the guide surface. Each of these flange portions projects outward in a radial direction of the pulley from the guide surface, and has a diameter larger than that of the guide surface. A corner with a roughly right angle is formed at a side of the guide surface of each of the flange portions.

However, in the driving unit described in Patent Document 1, a film made of resin is formed outside the cable in the radial direction to smoothen movement of the cable. A problem may occur that the film is strongly pressed to a corner of the flange portion to damage it and this causes durability of the cable to be deteriorated.

It is an object of the present invention to provide an opening-closing body driving device capable of improving durability of a cable.

In one aspect of the present invention, there is provided an opening-closing body driving device configured to drive an opening-closing body for opening and closing an opening portion. The opening-closing body driving device includes: a case; a drum having a spiral guide groove on an outer periphery of the drum, the drum being configured to be accommodated in the case; a cable, one end of the cable being wound in the guide groove, the other end of the cable being connected to the opening-closing body; a cable entrance portion provided on the case, the cable going in and out of the case from the cable entrance portion; a pulley holder provided between the drum in the case and the cable entrance portion, the pulley holder including a pulley shaft; a pulley provided rotatably around the pulley shaft and movably in an axial direction of the pulley shaft, the pully including a pulley groove on which the cable is wound; flange portions provided at both sides of the pulley in the axial direction, each of the flange portions preventing the cable to drop off from the pulley groove; and a spring member accommodated in the case, the spring member being configured to press the pulley holder in such a direction that a path length between the drum and the cable entrance portion is increased. In this case, a cross-sectional shape of the cable is formed into a round shape, and a cross-sectional shape of a connecting unit between the pulley groove of the pulley and each of the flange portions is formed into a circular arc shape.

In another aspect of the present invention, a cross-sectional shape of the pulley groove is formed into a circular arc shape, and a radius dimension of the pulley groove is a dimension is equal to or larger than a diameter dimension of the cable.

In still another aspect of the present invention, the pulley holder includes: a pair of support walls that respectively supports both sides of the pulley shaft in an axial direction, and controls movement of the pulley in the axial direction; a connecting wall disposed outside the pulley in a radial direction of the pulley to connect the pair of support walls to each other; a projecting portion provided on the connecting wall, the projecting portion projecting outside the pulley in the radial direction; a passing path provided inside the projecting portion to allow a locking block to pass through the passing path, the locking block being provided at one end of the cable; and a slit provided inside the projecting portion in the radial direction to guide winding of the cable from the passing path to the pulley groove.

In still another aspect of the present invention, a width dimension of the slit is set to a dimension by which the cable is allowed to pass through the slit and controls passage of the locking block.

In still another aspect of the present invention, a taper portion is formed between the passing path and the slit, the taper portion being configured to guide movement of the cable from the passing path to the slit.

In still another aspect of the present invention, the projecting portion is disposed at a central part of the connecting wall along the axial direction of the pulley shaft, and a clearance dimension between the slit and the connecting unit is a dimension larger than a clearance dimension between the slit and the flange portion in a state where the pulley comes into contact with the support wall.

In still another aspect of the present invention, the pulley is provided swingably with respect to the pulley shaft.

According to the present invention, a cross-sectional shape of a cable is formed into a round shape, and a cross-sectional shape of a connecting unit between a pulley groove of a pulley and a flange portion is formed into a circular arc shape. Thus, it is possible to surely suppress damage of the cable caused by being strongly pressed to a corner as a conventional manner. Therefore, it is possible to improve durability of the cable, whereby it is possible to extend a maintenance cycle of an opening-closing body driving device and obtain high reliability thereof.

BRIEF DESCRIPTIONS OF THE DRAWINGS

Figure 9:
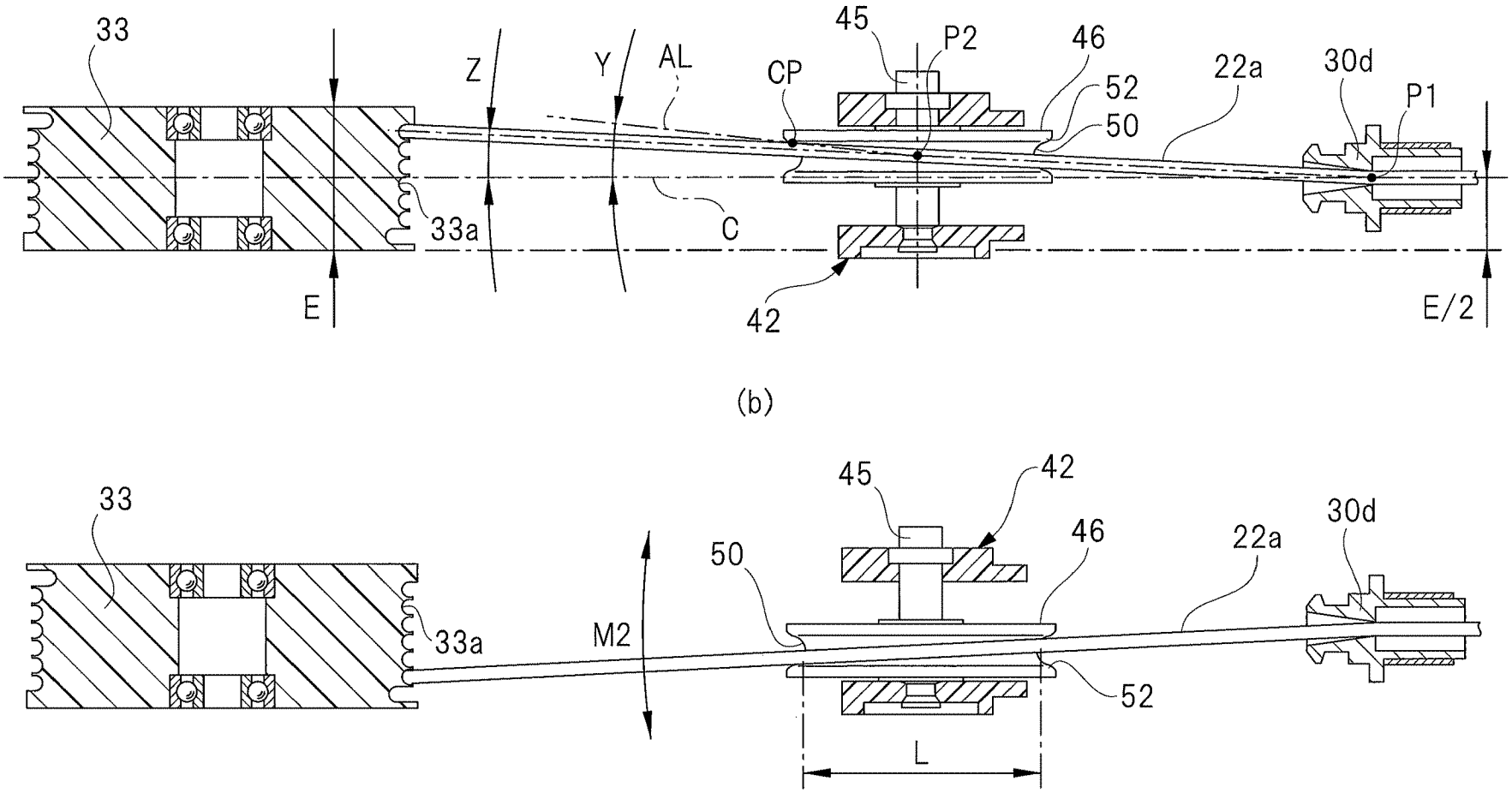

FIGS. 9(*a*) and 9(*b*) are explanatory drawings for explaining a moving state of a pulley in an axial direction with respect to the pulley shaft.

Figure 10:
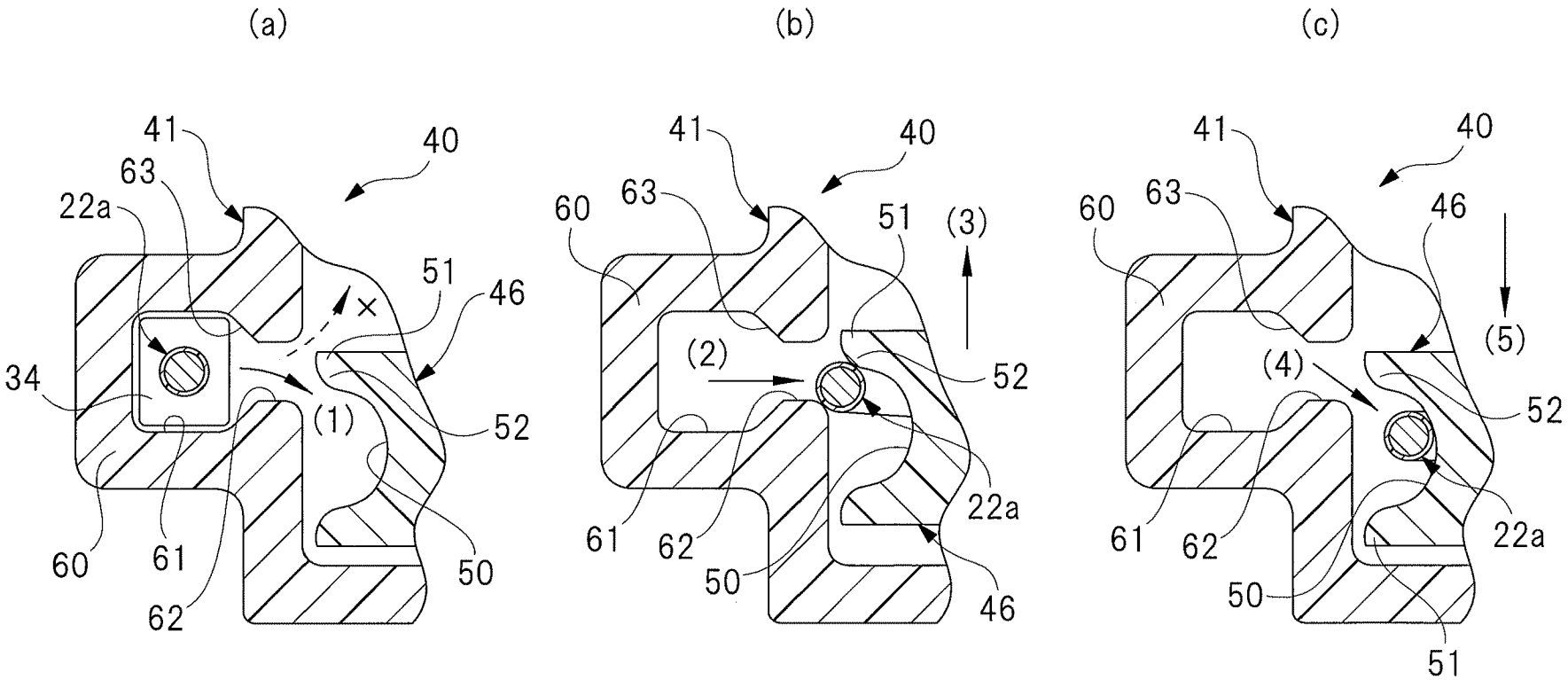

FIGS. 10(*a*), 10(*b*), and 10(*c*) are explanatory drawings for explaining a winding procedure of the cable to a pulley groove.

Figure 11:
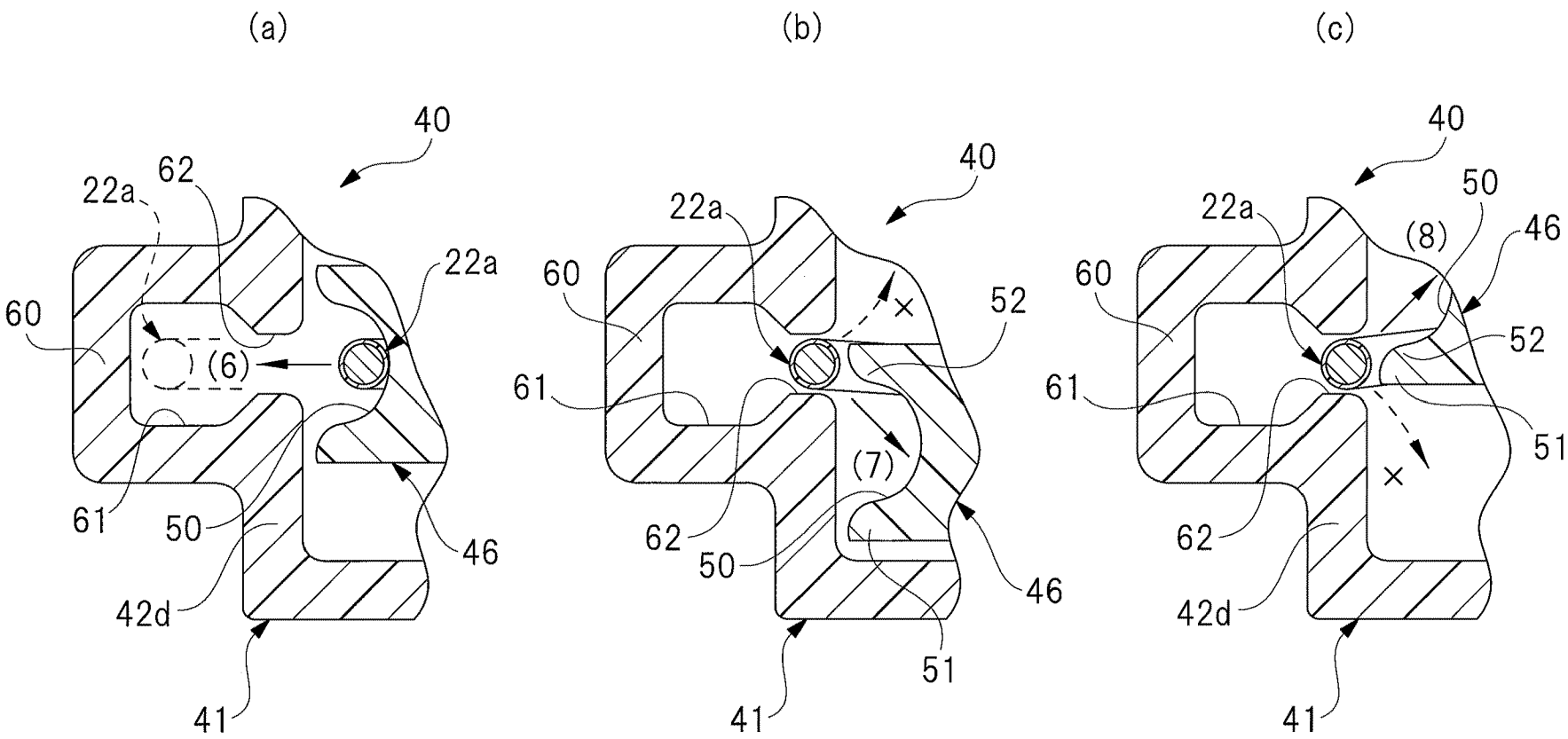

FIGS. 11(*a*), 11(*b*) and 11(*c*) are explanatory drawings for explaining that the cable is not dropped off from the pulley groove.

Figure 12:
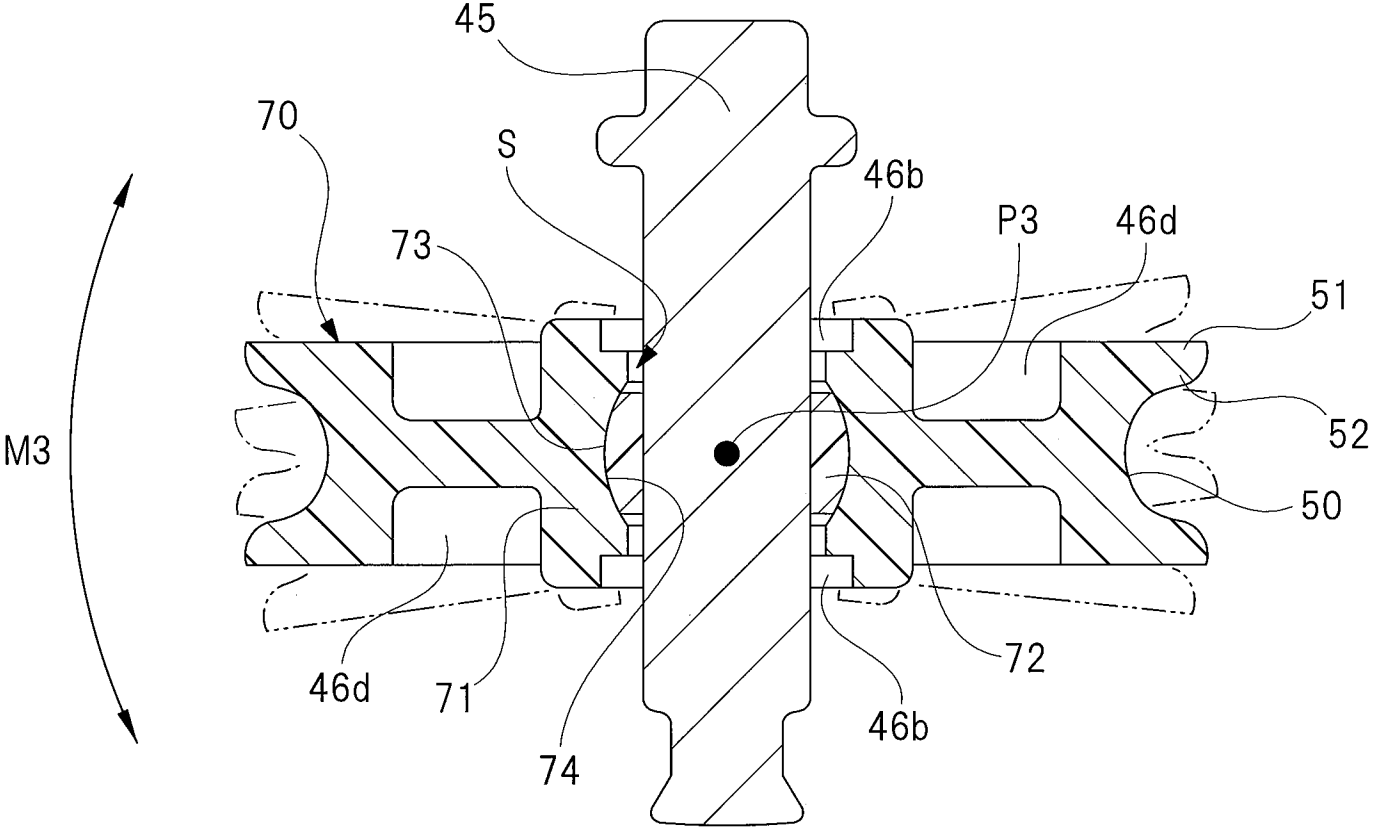

FIG. 12 is a cross-sectional view showing a periphery of a pulley in a tensioner mechanism according to a second embodiment.

Figure 8:
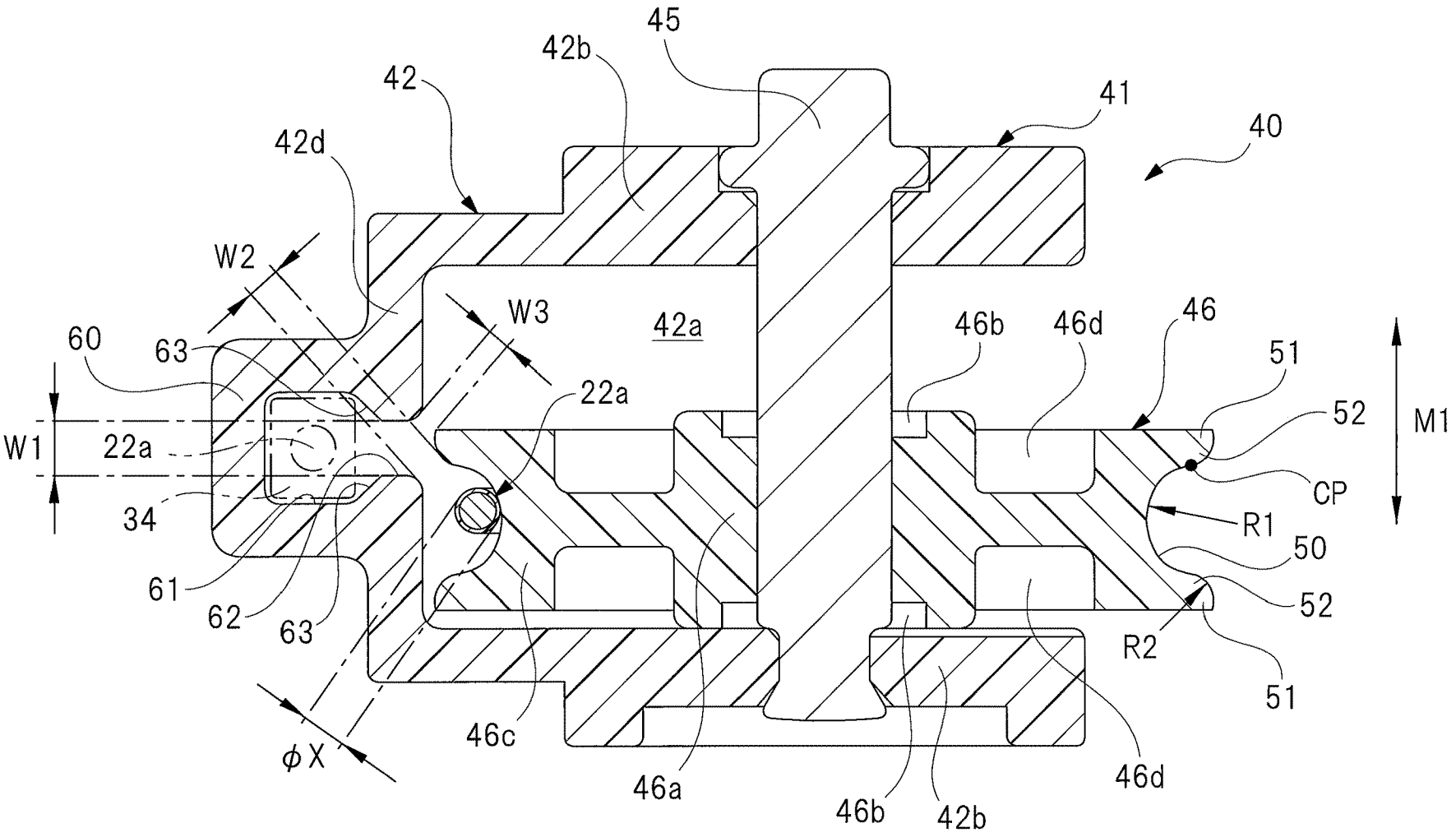
FIG. 8 is a cross-sectional view taken along a B-B line of FIG. 7, which passes through a pulley shaft.
Figure 13:
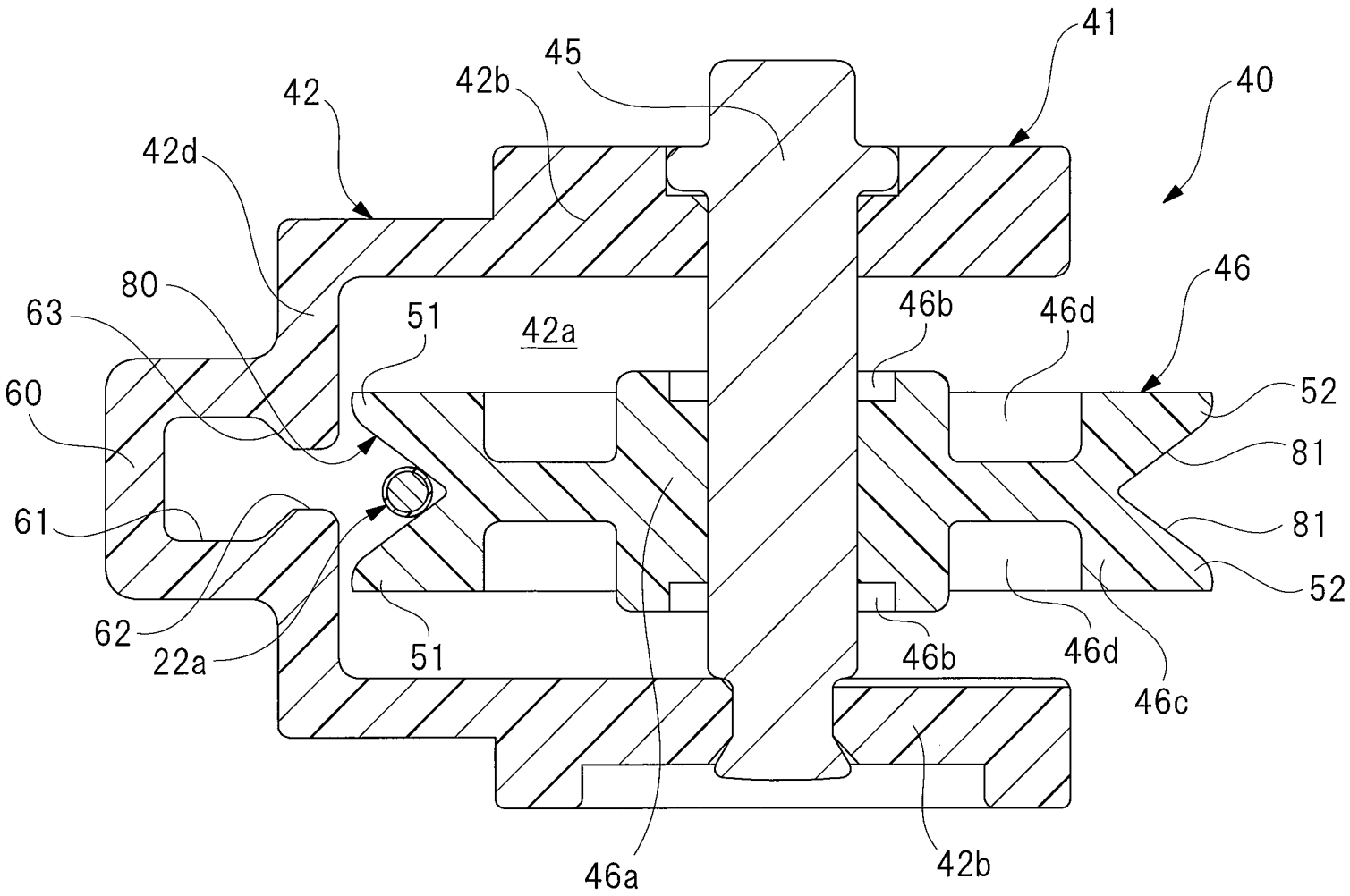

FIG. 13 is a cross-sectional view corresponding to FIG. 8 that shows a tensioner mechanism according to a third embodiment.

DETAILED DESCRIPTION

Hereinafter, a first embodiment according to the present invention will be described in detail with reference to the accompanying drawings.

First Embodiment

Figure 1:
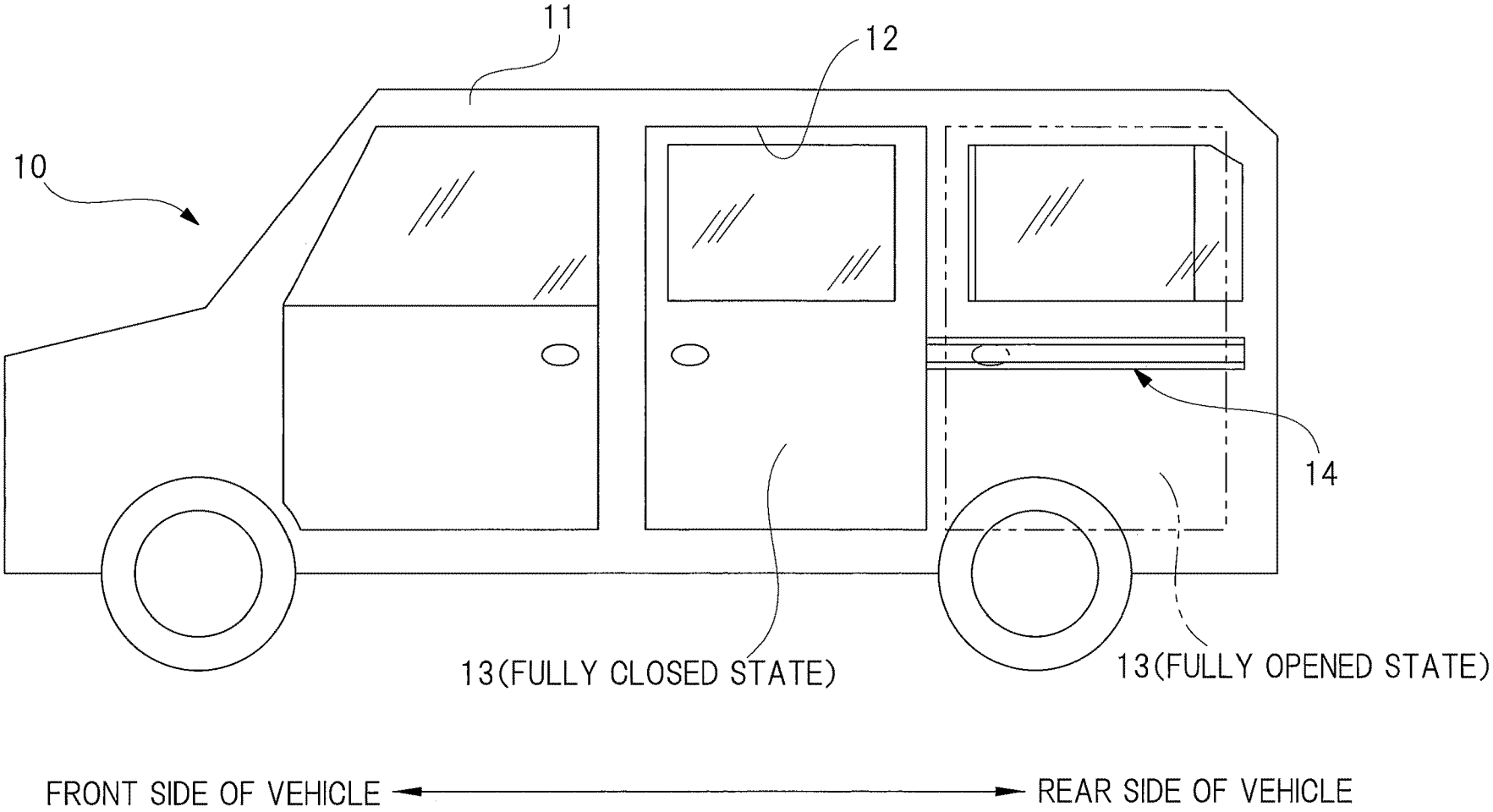
FIG. 1 is a side view of minivan.
Figure 2:
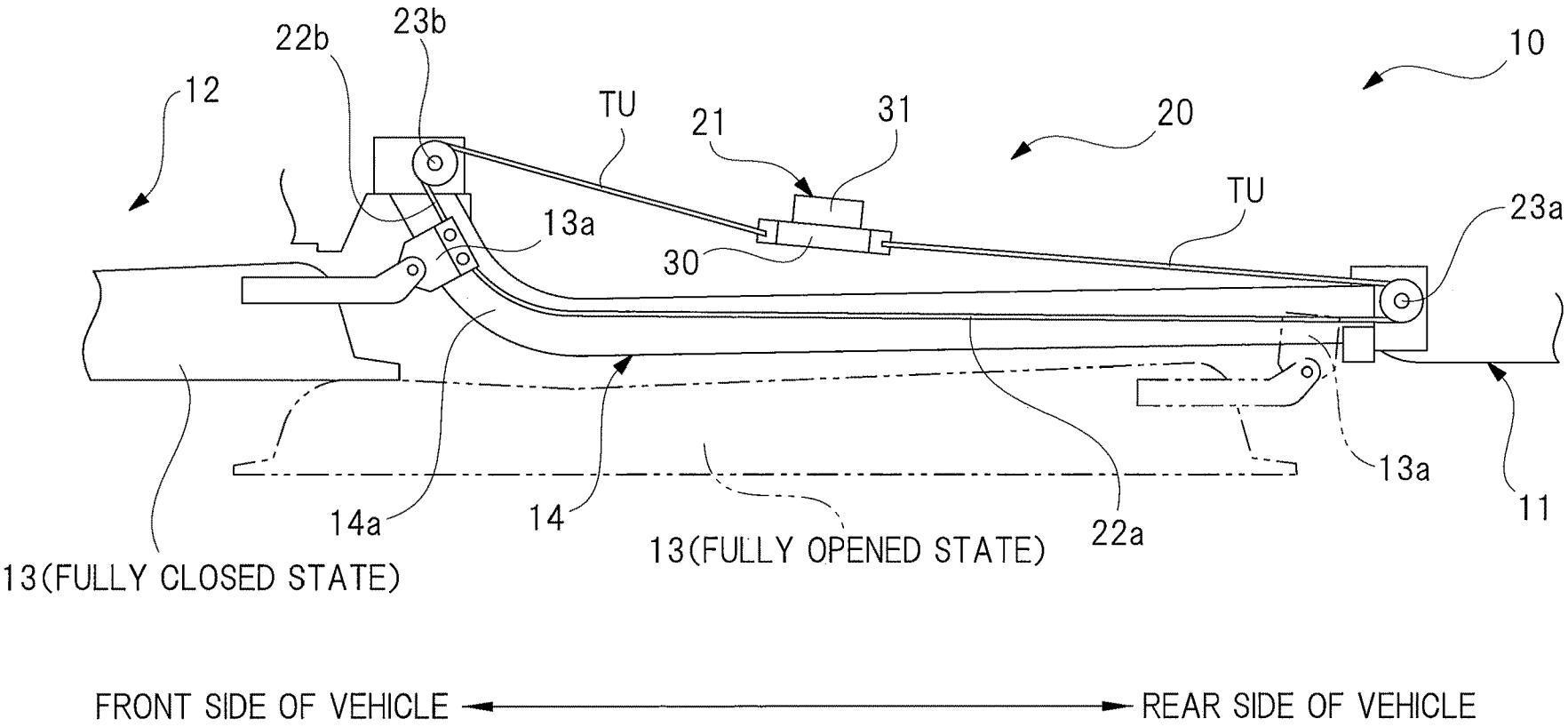
FIG. 2 is a plan view showing an assembling structure of a sliding door onto a vehicle body.
Figure 3:
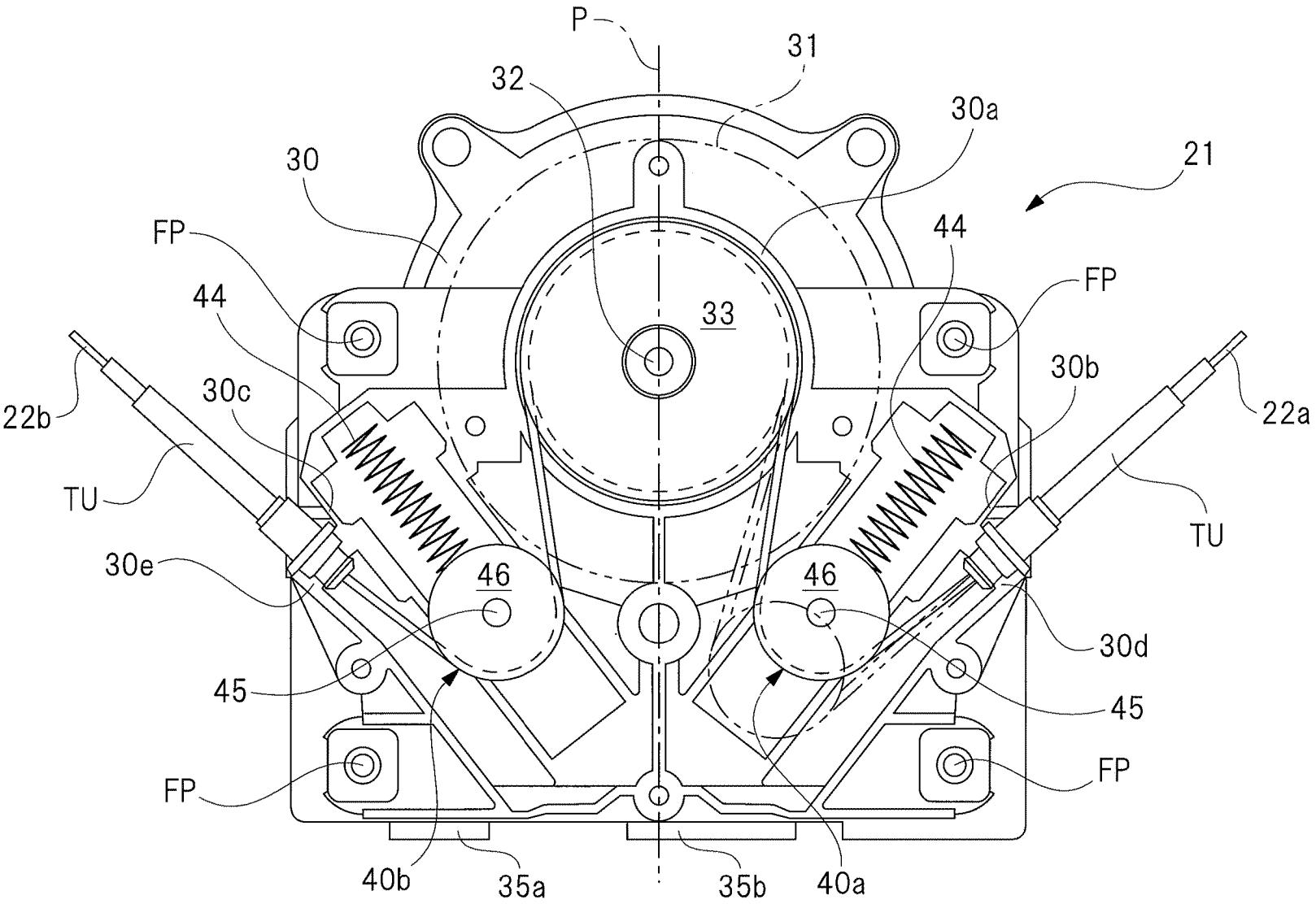
FIG. 3 is a front view showing an outline of a driving unit (without a cover).
Figure 4:
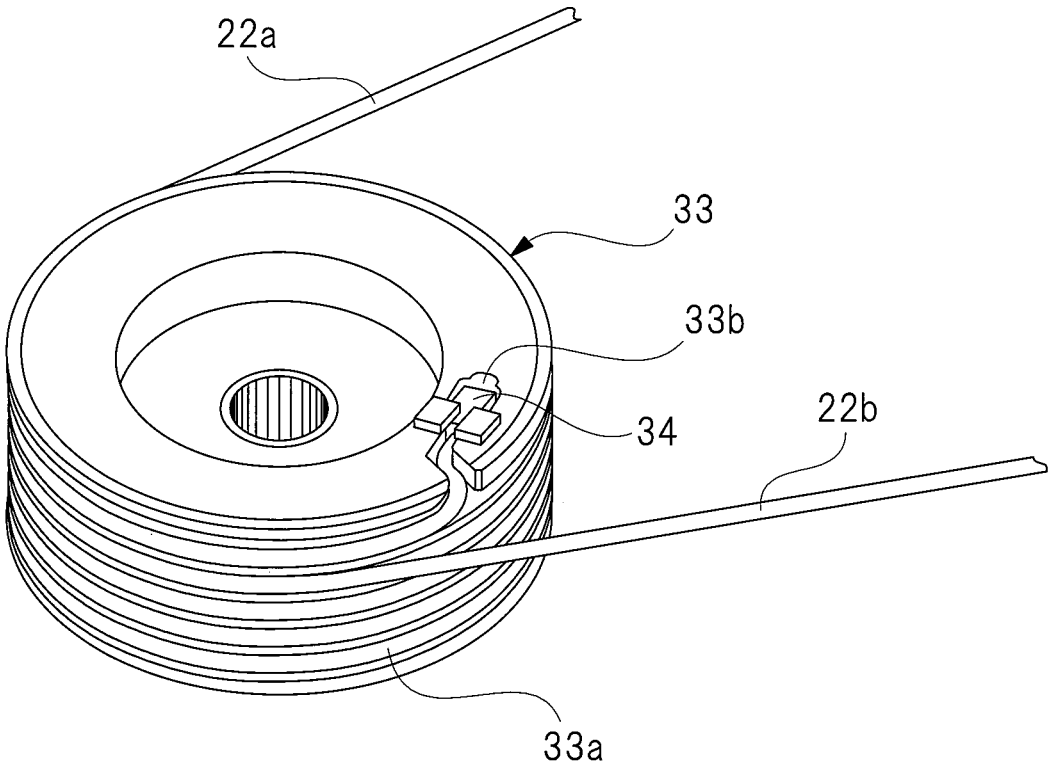
FIG. 4 is a perspective view showing details of a drum.
Figure 5:
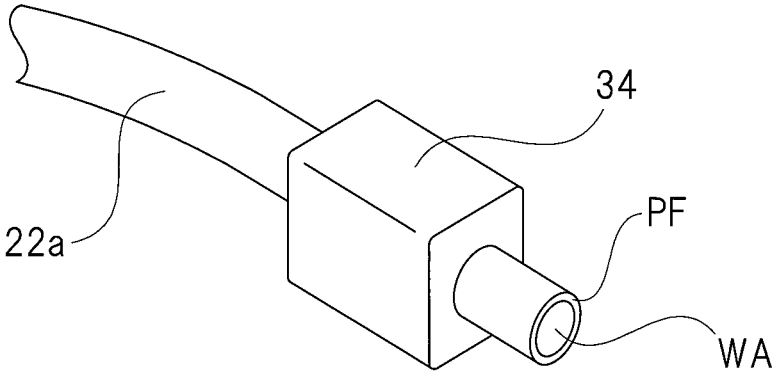
FIG. 5 is a perspective view showing a locking block that is fixed to a cable.

FIG. 1 shows a side view of a minivan or an estate car (so-called one-box car). FIG. 2 shows a plan view an assembling structure of a sliding door to a vehicle body. FIG. 3 shows a front view showing an outline of a driving unit (without a cover). FIG. 4 shows a perspective view showing details of a drum. FIG. 5 shows a perspective view showing a locking block that is fixed to a cable.

As shown in FIG. 1, a vehicle 10 is a minivan. A relatively large opening portion 12 is provided in a side portion of a vehicle body 11 that forms the vehicle 10. Further, a sliding door (that is, an opening-closing body) 13 is provided on the side portion of the vehicle body 11. The sliding door 13 is configured to open and close the opening portion 12. As shown in FIG. 2, the sliding door 13 includes a roller assembly 13*a*. The roller assembly 13*a* is configured to move along a guide rail 14 fixed on the side portion of the vehicle body 11.

When the roller assembly 13*a* moves along the guide rail 14, the sliding door 13 also moves along the side portion of the vehicle body 11. Specifically, the sliding door 13 is configured to move in a front-rear direction of the vehicle 10 between a "fully closed state" position indicated by a solid line in FIG. 1 and FIG. 2 and a "fully opened state" position indicated by a two-dot chain line in FIG. 1 and FIG. 2, thereby opening and closing the opening portion 12. Here, as shown in FIG. 2, a drawing portion 14*a* is provided at a portion of the guide rail 14 in a front side of the vehicle 10. The drawing portion 14*a* is curved toward the inside of a vehicle interior (upper side in FIG. 2). Thus, by guiding the roller assembly 13*a* toward the drawing portion 14*a*, the sliding door 13 blocks or closes the opening portion 12, and is stored in the same plane with respect to a side surface of the vehicle body 11.

As shown in FIG. 1, the roller assembly 13*a* and the guide rail 14 are provided at each of upper and lower portions (upper part and lower part) of the sliding door 13 in the front side of the vehicle 10 in addition to a central portion of the vehicle body 11 along up-and-down direction. Namely, the sliding door 13 is openably and closably supported at total three portions with respect to the vehicle body 11.

As shown in FIG. 2, a power sliding door device 20 is mounted on the vehicle 10. The power sliding door device 20 is configured to automatically open and close the sliding door 13. The power sliding door device 20 is a cable type operating apparatus for open and close, and includes a driving unit 21, an open-side cable 22*a*, and a close-side cable 22*b*. The driving unit 21 is disposed in the vehicle interior of the vehicle body 11 and roughly at a central part of the guide rail 14 along the front-rear direction of the vehicle 10. Further, each of the open-side cable 22*a* and the close-side cable 22*b* has a function to transmit power of the driving unit 21 to the sliding door 13.

The open-side cable 22*a* is introduced to the roller assembly 13*a* from a rear side of the vehicle 10 via a first inversion pulley 23*a*. The first inversion pulley 23*a* is placed at a rear side of the guide rail 14 in the vehicle 10. The open-side cable 22*a* is configured to pull the sliding door 13 to an open side in this manner. On the other hand, the close-side cable 22*b* is introduced to the roller assembly 13*a* from the front side of the vehicle 10 via a second inversion pulley 23*b*. The second inversion pulley 23*b* is placed at a front side of the guide rail 14 in the vehicle 10. The close-side cable 22*b* is configured to pull the sliding door 13 to a close side in this manner.

One end of each of the open-side cable 22*a* and the close-side cable 22*b* is introduced to the inside of the driving unit 21. When the open-side cable 22*a* is wound up by the driving unit 21, the sliding door 13 is pulled by the open-side cable 22*a* to automatically carry out an opening operation. On the other hand, when the close-side cable 22*b* is wound up by the driving unit 21, the sliding door 13 is pulled by the close-side cable 22*b* to automatically carry out a close operation.

As shown in FIG. 3, the driving unit 21 includes a case 30 made of resin material such as plastics. The case 30 also functions as a frame for supporting each of members and/or mechanisms that constitute the driving unit 21. The driving unit 21 is fixed to the vehicle body 11 (see FIG. 2) by bolts or the like (not shown in the drawings) via four fixing portions FP provided on the case 30. Here, the driving unit 21 constitutes an opening-closing body driving device according to the present invention.

An electric motor (motor) 31 is provided on the case 30. The electric motor 31 becomes a driving source of the driving unit 21. A flat-shaped brushless motor is adopted as the electric motor 31. The brushless motor can rotate in forward and reverse directions. This makes it possible to suppress a thickness dimension of the driving unit 21 from being increased. A decelerating mechanism (not shown in the drawings) is provided in the vicinity of the electric motor 31 and inside the case 30. The decelerating mechanism is made up by a planetary gear reducer. This allows rotational speed of the electric motor 31 to be reduced, whereby rotational power of an output shaft 32 becomes high torque.

Further, an electromagnetic clutch (not shown in the drawings) is provided between the decelerating mechanism and the output shaft 32. When the sliding door 13 (see FIG. 2) is manually operated to be opened and closed, this electromagnetic clutch is opened to shut off a power transmission route between the decelerating mechanism and the output shaft 32. This makes it possible to operate smoothly opening and closing the sliding door 13 by a small load.

As shown in FIG. 3, a drum housing chamber 30*a* formed into a roughly cylindrical shape is provided at a roughly central portion of the case 30. The drum housing chamber 30*a* is coaxially disposed with respect to the electric motor 31. A driving drum (drum) 33 is accommodated rotatably in the inside of the drum housing chamber 30*a*.

As shown in FIG. 4, the driving drum 33 is formed into a roughly columnar shape, and includes a spiral guide groove 33*a* on an outer periphery thereof. The driving drum 33 is fixed to the output shaft 32 at a shaft center thereof. The output shaft 32 projects to the drum housing chamber 30*a*. This causes the driving drum 33 to be rotatively driven by the electric motor 31, whereby the driving drum 33 rotates in forward and reverse directions inside the drum housing chamber 30*a*. Note that the driving drum 33 and the output shaft 32 undergo serration engagement with each other, whereby they integrally rotate surely without sliding with each other.

One end of the open-side cable 22*a* introduced to the driving unit 21 is wound along the guide groove 33*a* from one side of the driving drum 33 in an axial direction. Further, as shown in FIG. 5, a locking block 34 made of metal is rigidly fixed to one end of the open-side cable 22*a* by means of calking or the like. The locking block 34 is formed into a roughly square pole shape. The locking block 34 is locked into a locking hole 33*b* that is provided on one side surface of the driving drum 33 in the axial direction. This causes the one end of the open-side cable 22*a* to be fixed to the driving drum 33.

As well as this, one end of the close-side cable 22*b* introduced to the driving unit 21 is wound along the guide groove 33*a* from the other side of the driving drum 33 in the axial direction. Further, a locking block (not shown in the drawings) similar to that for the open-side cable 22*a* is also fixed to the one end of the close-side cable 22*b*. This locking block (at the close side) is locked into a locking hole (not shown in the drawings), which is provided on the other side surface of the driving drum 33 in the axial direction. Thus, the one end of each of the open-side cable 22*a* and the close-side cable 22*b* is wound along the guide groove 33*a* of the driving drum 33, and the other end thereof is connected to the sliding door 13.

A board housing chamber (not shown in the drawings) is provided at a portion of a rear side of the drum housing chamber 30*a* in the case 30. The portion is close to an open-side tensioner mechanism 40*a* and a close-side tensioner mechanism 40*b* (lower portion in FIG. 3). A control board (not shown in the drawings) is accommodated in the board housing chamber. The control board is configured to control operations of the electric motor 31 and the electromagnetic clutch. The control board has a structure in which electronic components such as a CPU, a memory, and a driving circuit are mounted on a board. The control board is electrically connected to a battery (power source) mounted on the vehicle 10 and an opening/closing switch and the like in the vehicle interior (all of which are not shown in the drawings) via connector connecting units 35*a*, 35*b*.

When the opening/closing switch receives an "opening operation" by a driver or the like, the electric motor 31 is rotatively driven in a counterclockwise direction. This causes the output shaft 32 and the driving drum 33 to rotate in the counterclockwise direction with high torque. Therefore, the open-side cable 22*a* is wound up around the driving drum 33 while pulling the sliding door 13, whereby the sliding door 13 automatically carries out the open operation. At this time, with rotation of the driving drum 33 in the counterclockwise direction, the close-side cable 22*b* is sent out to the outside of the case 30 from the driving drum 33.

On the other hand, when the opening/closing switch receives a "closing operation" by the driver or the like, the electric motor 31 is rotatively driven in a clockwise direction. This causes the output shaft 32 and the driving drum 33 to rotate in the clockwise direction with high torque. Therefore, the close-side cable 22*b* is wound up around the driving drum 33 while pulling the sliding door 13, whereby the sliding door 13 automatically carries out the close operation. At this time, with rotation of the driving drum 33 in the clockwise direction, the open-side cable 22*a* is sent out to the outside of the case 30 from the driving drum 33.

As shown in FIG. 3, an open-side tensioner housing chamber 30*b* and a close-side tensioner housing chamber 30*c* are provided in the case 30 so as to be adjacent to the drum housing chamber 30*a*. Then, the open-side cable 22*a* and the close-side cable 22*b* introduced to the inside of the case 30 are respectively drawn to the open-side tensioner housing chamber 30*b* and the close-side tensioner housing chamber 30*c* from an open-side cable entrance portion 30*d* and a close-side cable entrance portion 30*e* provided on the case 30. Namely, the cables 22*a*, 22*b* are respectively allowed to go in and out of the case 30 from the cable entrance portions 30*d*, 30*e*, and are respectively introduced to the drum housing chamber 30*a* via the tensioner housing chambers 30*b*, 30*c*.

The open-side tensioner mechanism 40*a* and the close-side tensioner mechanism 40*b* are respectively accommodated in the open-side tensioner housing chamber 30*b* and the close-side tensioner housing chamber 30*c*. The open-side tensioner mechanism 40*a* and the close-side tensioner mechanism 40*b* respectively apply predetermined tension to the open-side cable 22*a* and the close-side cable 22*b*. By providing the tensioner mechanisms 40*a*, 40*b* in this manner, each of the cables 22*a*, 22*b* does not bend even though any of the cables 22*a*, 22*b* is elongated due to repeated pulling operations for the sliding door 13 and a change in a path length thereof occurs. Illustration for each of the tensioner mechanisms 40*a*, 40*b* shown in FIG. 3 is simplified in order to easily understand explanation thereof.

Here, outer tubes TU each having flexibility are respectively provided between the cable entrance portions 30*d*, 30*e* of the case 30 and the inversion pulleys 23*a*, 23*b*. The cables 22*a*, 22*b* are respectively inserted into the outer tubes TU and are configured to move in the outer tubes TU between the cable entrance portions 30*d*, 30*e* and the inversion pulleys 23*a*, 23*b*.

Further, an opening portion of the case 30 (near side in FIG. 3) is blocked or closed by a cover made of resin (not shown in the drawings). This causes the drum housing chamber 30*a* and each of the tensioner housing chambers 30*b*, 30*c* to be sealed, whereby it is possible to surely prevent rain water, dust, or the like from entering the inside thereof.

Hereinafter, a detailed structure of the open-side tensioner mechanism 40*a* and the close-side tensioner mechanism 40*b* will be described by using the drawings. Note that each of the tensioner mechanisms 40*a*, 40*b* is formed into the same shape so as to become mirror-image symmetry across a central line P of FIG. 3. Therefore, a detailed structure thereof will be described below by representing the open-side tensioner mechanism 40*a*. Further, in the following explanation, the open-side tensioner mechanism 40*a* will be described simply as a "tensioner mechanism 40".

Figure 6:
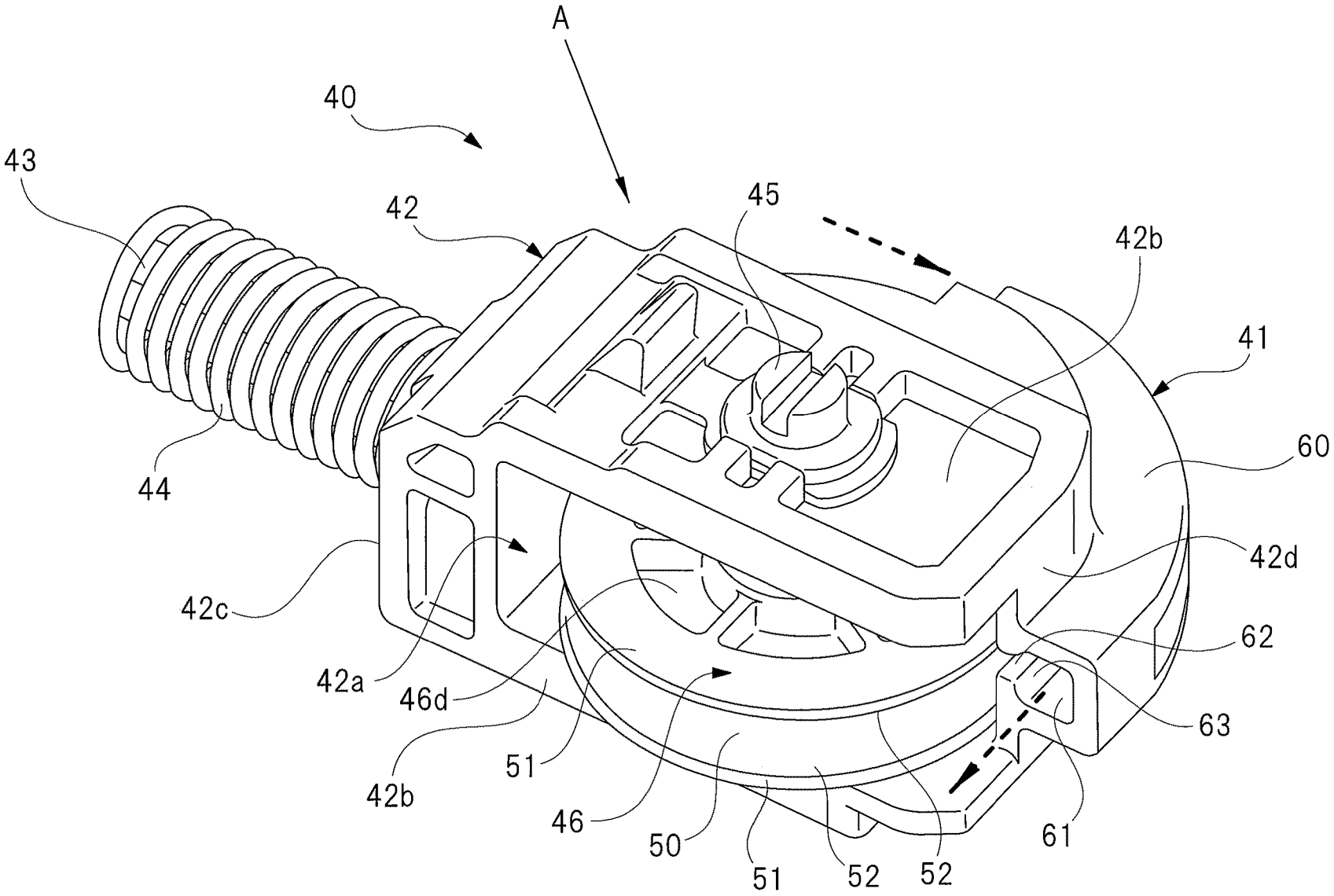
FIG. 6 is a perspective view showing details of an open-side tensioner mechanism shown in FIG. 3.
Figure 7:
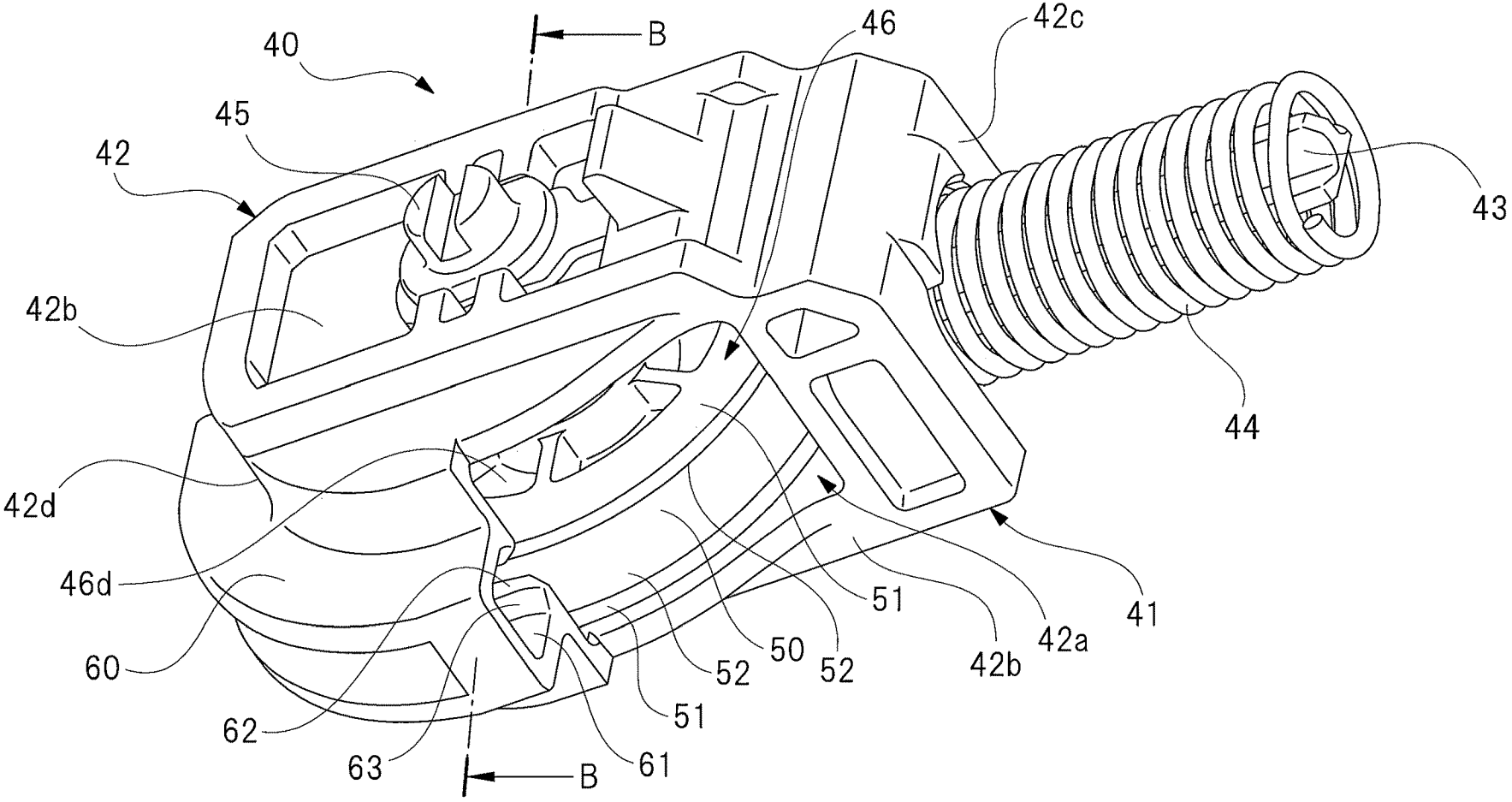
FIG. 7 is a perspective view when the tensioner mechanism of FIG. 6 is viewed from a direction of an arrow A.

FIG. 6 shows a perspective view showing details of the open-side tensioner mechanism shown in FIG. 3. FIG. 7 shows a perspective view when the tensioner mechanism shown in FIG. 6 is viewed from a direction of an arrow A. FIG. 8 shows a cross-sectional view taken along a B-B line of FIG. 7, which passes through a pulley shaft. FIGS. 9(*a*) and 9(*b*) respectively show explanatory drawings for explaining a moving state of a pulley in an axial direction with respect to the pulley shaft of the pulley. FIGS. 10(*a*), 10(*b*), and 10(*c*) respectively show explanatory drawings for explaining a winding procedure of the cable to a pulley groove. FIGS. 11(*a*), 11(*b*), and 11(*c*) respectively show explanatory drawings for explaining that the cable is not dropped off from the pulley groove.

As shown in FIG. 6 and FIG. 7, the tensioner mechanism 40 is provided between the driving drum 33 in the case 30 and the open-side cable entrance portion 30*d*. The tensioner mechanism 40 includes a pulley holder 41 that is formed into a predetermined shape by means of injection molding of resin material such as plastics or the like. The pulley holder 41 includes a main body 42 and a guide shaft 43. The main body 42 includes a pulley housing chamber 42*a* in the inside thereof. The guide shaft 43 is integrally provided with the main body 42.

The main body 42 of the pulley holder 41 includes a pair of support walls 42*b* each of which is formed into a roughly rectangular shape. A first connecting wall 42*c* for connecting the support walls 42*b* to each other is provided at one side of each of the support walls 42*b* in a longitudinal direction. A second connecting wall 42*d* for connecting the support walls 42*b* is provided at the other side of each of the support walls 42*b* in the longitudinal direction. In other words, the first and second connecting walls 42*c* and 42*d* respectively support both sides of each of the support walls 42*b* in the longitudinal direction, and are disposed outside of the pulley 46 in a radial direction. Further, a base end side of the guide shaft 43 in an axial direction is coupled to an opposite side of the first connecting wall 42*c* with respect to the second connecting wall 42*d*.

A tip side of the guide shaft 43 in the axial direction is fitted to a through hole (not shown in the drawings) provided on the open-side tensioner housing chamber 30*b* (see FIG. 3) so as to be allowed to go in and out of the through hole. This allows the pulley holder 41 to move inside the case 30 in a direction (orthogonal direction) intersecting with an axial direction of the output shaft 32 (see FIG. 3). Thus, the guide shaft 43 regulates a moving direction of the pulley holder 41 with respect to the case 30.

Further, a coil spring (spring member) 44 is fitted to the guide shaft 43. In other words, the guide shaft 43 also has a function as a spring supporting unit configured to support the coil spring 44. The coil spring 44 is disposed between the open-side tensioner housing chamber 30*b* of the case 30 and the main body 42 of the pulley holder 41 in a state where a predetermined initial load is applied to the coil spring 44 (that is, a state where the coil spring 44 is contracted to an extent). Herewith, even though the open-side cable 22*a* extends and the path length increases, as shown by a two-dot chain line in FIG. 3, the pulley holder 41 is pressed to the coil spring 44, thereby eliminating slack of the open-side cable 22*a*. Thus, the coil spring 44 is configured to press the pulley holder 41 in a direction to increase a path length of the open-side cable 22*a* between the driving drum 33 and the open-side cable entrance portion 30*d*.

As shown in FIG. 8, a pulley shaft 45 is provided between the pair of support walls 42*b* provided in the pulley holder 41 so as to cross the pulley housing chamber 42*a*. The pulley shaft 45 is constituted by a columnar steel rod. Namely, the support walls 42*b* respectively support both sides of the pulley shaft 45 in an axial direction. The pulley shaft 45 is extended in a direction (orthogonal direction) intersecting with an extending direction of the guide shaft 43 (see FIG. 7). Namely, the pulley shaft 45 becomes parallel to the output shaft 32 (see FIG. 3). By caulking an end portion of the pulley shaft 45 in the axial direction, the pulley shaft 45 is fixed at a roughly central part of each of the support walls 42*b* (see FIG. 6 and FIG. 7). Since the both sides of each of the support walls 42*b* in the longitudinal direction are respectively supported by the connecting walls 42*c* and 42*d*, each of the support walls 42*b* never bends at the time of caulking fixation of the pulley shaft 45 to the respective support walls 42*b*.

The pulley 46 is rotatably supported on the pulley shaft 45. Here, as shown in FIG. 8, a thickness dimension of the pulley 46 is set to a dimension of about a half of a thickness dimension of the pulley housing chamber 42*a*. This allows the pulley 46 to move in the axial direction with respect to the pulley shaft 45 as shown by an arrow M1. Note that an adequate amount of grease (lubricating oil) is applied between the pulley 46 and the pulley shaft 45 at the time of assembling of the tensioner mechanism 40 (not shown in the drawings). This allows the pulley 46 to smoothly rotate and move with respect to the pulley shaft 45 over a long time. Here, the pulley 46 is movable in the axial direction of the pulley shaft 45, but a moving amount thereof is controlled by the support walls 42*b*.

The pulley 46 is formed into a roughly disk shape by resin material such as plastics. A cylindrical mounting portion 46*a* is provided inside the pulley 46 in the radial direction. The mounting portion 46*a* is mounted on the pulley shaft 45. Grease stops 46*b* are respectively provided at both sides of the mounting portion 46*a* in an axial direction. Each of the grease stops 46*b* becomes depressed in the axial direction of the mounting portion 46*a*. This causes grease to be supplied between the pulley 46 and the pulley shaft 45.

An annular pulley body 46*c* is integrally provided outside the mounting portion 46*a* in the radial direction. A plurality of relief recesses 46*d* is formed between the mounting portion 46*a* and the pulley body 46*c*. These relief recesses 46*d* are disposed at predetermined intervals in a circumferential direction of the pulley 46, and contribute weight saving of the pulley 46 and prevention of deformation (or prevention of generation of a sink mark) at the time of injection molding of the pulley 46. This makes it possible to sufficiently secure coaxiality between the mounting portion 46*a* and the pulley body 46*c*, whereby the pulley 46 with high accuracy, which is made of resin, can be realized.

A pulley groove 50 is provided outside the pulley body 46*c* in the radial direction. A cross-sectional shape of the pulley groove 50 is formed into a circular arc shape. This pulley groove 50 is provided over the whole area of the pulley body 46*c* in a circumferential direction. As shown in FIG. 8, a radius dimension of a cross-sectional surface of the pulley groove 50 is R1. More specifically, a diameter dimension (R1×2) of the cross-sectional surface of the pulley groove 50 becomes a dimension of about ⅔ (two third) of a thickness dimension of the pulley body 46*c*.

Further, flange portions 51 are respectively provided at both sides (upper and lower sides in FIG. 8) of the pulley body 46*c* in the axial direction. Each of the flange portions 51 projects outward in the radial direction from the pulley groove 50. These flange portions 51 are provided over the whole area of the pulley body 46*c* in the circumferential direction. The flange portions 51 have a function to prevent the open-side cable 22*a* wound on the pulley groove 50 to drop off from the pulley groove 50.

Moreover, connecting units 52 are respectively provided between the pulley groove 50 and the flange portions 51 along the axial direction of the pulley 46. A cross-sectional shape of each of the connecting units 52 is formed into a circular arc shape. The pair of connecting units 52 is provided over the whole area of the pulley body 46*c* in the circumferential direction. A radius dimension of each of the connecting units 52 becomes a radius dimension R2 that is roughly a half of the radius dimension R1 of the pulley groove 50 (R2≈R×½). Here, the pulley groove 50 becomes hollow toward the inside of the pulley body 46*c* in the radial direction, but the pair of connecting units 52 projects outward in the radial direction of the pulley body 46*c* and toward the pulley groove 50. A curved line to form a cross-sectional surface of the pulley groove 50 is smoothly connected to a curved line to form a cross-sectional surface of each of the connecting units 52 each other at a connecting point CP (FIG. 8 merely shows one point). No corner is formed at this connecting point CP.

Herewith, even though the open-side cable 22*a* flops in the pulley groove 50 by driving of the driving unit 21 (see FIG. 3) and moves toward any of the flange portions 51, the open-side cable 22*a* merely comes into contact with the pulley groove 50 with the radius dimension R1 and the connecting unit 52 with the radius dimension R2 (both are a potion having the circular arc shape). Therefore, since the open-side cable 22*a* does not come into contact with any corner unlike a conventional manner, it is possible to surely prevent early damage of the open-side cable 22*a*.

Here, as shown in FIG. 5, the open-side cable 22*a* is formed by a wire WA and a film PF. The wire WA is formed by twisting a plurality of thin iron wires. The film PF is made of resin to coat an outer periphery of the wire WA. Further, a cross-sectional shape of the open-side cable 22*a* is a round shape, and a diameter dimension of the open-side cable 22*a* becomes φX. More specifically, the diameter dimension φX of the open-side cable 22*a* becomes a dimension of about ⅓ (one third) of the diameter dimension (R1×2) of the cross-sectional surface of the pulley groove 50 (φX≈(R1×2)/3). In other words, the radius dimension R1 of the pulley groove 50 is set to a dimension that is equal to or larger than the diameter dimension φX of the open-side cable 22*a*. Thus, according to the pulley 46, it is possible to surely prevent early damage of the film PF having low rigidity. Therefore, it is possible to prevent the wire WA from being exposed to the outside to get rusty early or prevent a peeling film PF from obstructing the winding operation of the open-side cable 22*a* (that is, the operation of the driving unit 21).

As shown in FIG. 8, a projecting portion 60 is provided on the second connecting wall 42*d* that forms the main body 42 of the pulley holder 41. The projecting portion 60 projects outside the pulley 46 in the radial direction thereof. A cross-sectional shape of the projecting portion 60 is formed in a U-shaped manner. A passing path 61 is formed inside the projecting portion 60. The passing path 61 allows the locking block 34 (shown by a two-dot chain line in FIG. 8) fixed to the one end of the open-side cable 22*a* to pass therethrough. A cross-sectional shape of the passing path 61 is formed into a roughly rectangular shape. The locking block 34 is not allowed to incline and rotate inside the passing path 61. Therefore, the locking block 34 can pass through the passing path 61 smoothly, whereby it is possible to improve assembly operability of the driving unit 21 (see FIG. 3). At the time of assembling of the driving unit 21, an arranging operation of the open-side cable 22*a* to the pulley 46 is carried out as shown by a bold dashed arrow in FIG. 6.

As shown in FIG. 6 and FIG. 7, the projecting portion 60 is provided in a range of about 90° around the pulley 46, and is formed into a roughly circular arc shape in planar view. More specifically, the projecting portion 60 is disposed near the open-side cable entrance portion 30*d* (see FIG. 3) with respect to a shaft center of the guide shaft 43.

As shown in FIG. 8, a slit 62 is provided inside the projecting portion 60 in the radial direction. The slit 62 is configured to guide winding (or arrangement) of the open-side cable 22*a* from the passing path 61 to the pulley groove 50. This slit 62 is provided over the whole area of the projecting portion 60 in a circumferential direction. A width dimension W1 of an opening portion of the slit 62 becomes constant over the whole area of the projecting portion 60 in the circumferential direction. Here, the width dimension W1 of the slit 62 is set to a width dimension by which the open-side cable 22*a* can pass therethrough, that is, a width dimension that is somewhat larger than the diameter dimension φX of the open-side cable 22*a* (W1>φX). Herewith, the slit 62 allows the open-side cable 22*a* to pass therethrough, and controls the passage of the locking block 34. Therefore, at the time of assembling of the driving unit 21, winding of the open-side cable 22*a* onto the pulley groove 50 is guided without catching the locking block 34 by the slit 62, whereby it is possible to carry out the work smoothly.

Further, a pair of taper portions 63 is formed between the passing path 61 and the slit 62. The pair of taper portions 63 is configured to guide movement of the open-side cable 22*a* from the passing path 61 to the slit 62. These taper portions 63 are provided over the whole area of the projecting portion 60 in a circumferential direction, and are disposed at both sides along the axial direction of the pulley shaft 45 on the passing path 61 and the slit 62. This makes it possible to smoothly move the open-side cable 22*a* from the passing path 61 to the slit 62, whereby it is possible to easily carry out a winding operation of the open-side cable 22*a* onto the pulley groove 50. However, each of the taper portions 63 is not limited to a configuration in which the taper portion 63 is provided over the whole area of the projecting portion 60 in a circumferential direction. For example, a plurality of taper portions 63 may be provided partially in the circumferential direction of the projecting portion 60.

As shown in FIG. 8, the projecting portion 60 is disposed at a central part of the second connecting wall 42*d* along the axial direction of the pulley shaft 45. Herewith, in a state where the pulley 46 moves downward with respect to the pulley shaft 45 and the pulley 46 comes into contact with the lower support wall 42*b* (that is, a state shown in FIG. 8), a peripheral portion of the flange portion 51 provided in the pulley 46 is caused to face the slit 62 from the radial direction of the pulley 46. At this time, a clearance dimension W2 between the slit 62 and the connecting unit 52 is a dimension larger than a clearance dimension W3 between the slit 62 and the flange portion 51 (W2>W3).

Here, a size relationship of the diameter dimension φX of the open-side cable 22*a*, the width dimension W1 of the slit 62, the clearance dimension W2 between the slit 62 and the connecting unit 52, and the clearance dimension W3 between the slit 62 and the flange portion 51 is marshalled, it becomes "W1>φX>W2>W3". Herewith, in a case where the winding operation of the open-side cable 22*a* onto the pulley groove 50 is carried out from the state shown in FIG. 8, the open-side cable 22*a* surely moves toward the pulley groove 50 without necessity of visual contact. This is because W2 is larger than W3 and the pulley 46 can move merely in a direction to make W2 larger with respect to the pulley shaft 45 from the state shown in FIG. 8. In other words, as can be apparent from FIG. 8, W2 can become larger due to movement of the pulley 46, but W3 does not become larger. Therefore, it is possible to carry out the winding operation of the open-side cable 22*a* onto the pulley groove 50 easily and surely.

Contrary to the above, in a state where the pulley 46 comes into contact with the upper support wall 42*b* (not shown in the drawings), the similar dimension relationship to the above can also be obtained. Therefore, in the state where the pulley 46 comes into contact with the upper support wall 42*b*, it is also possible to carry out the winding operation of the open-side cable 22*a* onto the pulley groove 50 easily and surely.

As shown in FIG. 9, the guide groove 33*a* of the driving drum 33 is formed into a spiral shape. This causes a winding position of the open-side cable 22*a* with respect to the driving drum 33 (that is, a drawing position of the open-side cable 22*a* from the driving drum 33) to change to the axial direction of the driving drum 33 with rotation of the driving drum 33. On the other hand, the cable entrance portion 30*d* of the case 30 is always in a position corresponding to a central part of the driving drum 33 in the axial direction regardless of the rotation of the driving drum 33. Specifically, when a length of the driving drum 33 in the axial direction is E, the position of the cable entrance portion 30*d* becomes a position of E/2.

Herewith, an inclination angle Z of the open-side cable 22*a* between the cable entrance portion 30*d* and the driving drum 33 (FIG. 9(*a*) shows that the inclination angle Z becomes the maximum inclination angle of the open-side cable 22*a* based on a reference line C) changes on a reference point P1 with the rotation of the driving drum 33. When the inclination angle Z of the open-side cable 22*a* changes, a moving route of the open-side cable 22*a* at a position at which the pulley 46 is disposed changes in the axial direction of the pulley shaft 45 (that is, an up-and-down direction in FIG. 9). Then, the pulley 46 moves in the axial direction with respect to the pulley shaft 45 so as to follow the change in the moving route of the open-side cable 22*a*.

Here, FIG. 9(*a*) shows a state where the sliding door 13 (see FIG. 2) is in a fully closed state and most of the open-side cable 22*a* is pulled out from the driving drum 33. On the other hand, FIG. 9(*b*) shows a state where the sliding door 13 is in a fully opened state and most of the open-side cable 22*a* is wound up around the driving drum 33. In other words, the open-side cable 22*a* swings on the reference line C in the up-and-down direction in FIG. 9(*a*) as shown by an arrow M2 while opening and closing of the sliding door 13. The maximum swing angle of the open-side cable 22*a* at this time is twice the inclination angle Z.

The open-side cable 22*a* carries out a swing motion in this manner while opening and closing the sliding door 13. However, an extending direction of the pulley groove 50 maintains a state where it is kept parallel to the reference line C. For this reason, the open-side cable 22*a* carries out the swing motion on a reference point P2 in the pulley groove 50. At this time, the open-side cable 22*a* is strongly pressed toward the pair of flange portions 51 (see FIG. 8), which is provided in the pulley 46. On the other hand, in the present embodiment, the connecting unit 52 whose cross-sectional shape is the circular arc shape (see FIG. 8) is provided between the pulley groove 50 and each of the flange portions 51. For this reason, it is possible to disperse stress concentration that acts on the open-side cable 22*a* compared with the conventional manner. Therefore, it is possible to prevent the film PF (see FIG. 5) of the open-side cable 22*a* from being early damaged.

Further, in order to eliminate slack thereof, relatively large pressing force (spring force of the coil spring 44) is transmitted to the open-side cable 22*a* from the coil spring 44 via the pulley 46. Therefore, relatively large stress, which can generate so-called "irregular shape of winding (or losing shape)" so as to peel the film PF from the wire WA (see FIG. 5), acts on the film PF of the open-side cable 22*a*. On the other hand, in the present embodiment, the open-side cable 22*a* is brought into contact with the pulley groove 50 and the connecting unit 52 whose cross-sectional shapes are formed into the circular arc shape. For this reason, it is possible to disperse the stress concentration that acts on the open-side cable 22*a* compared with the conventional manner. In the conventional technique described above, a flat guide surface formed on an outer periphery of a pulley and corners of a pair of flange portions are pressed to a cable whose cross-sectional shape is a round shape. For this reason, there has been a possibility that "irregular shape of winding" due to stress concentration is early generated.

Here, with reference to FIG. 9, the radius dimension R1 of the cross-sectional surface of the pulley groove 50 and the radius dimension R2 of the connecting unit 52 (see FIG. 8) are set in a manner as follows. This makes it possible to disperse the stress concentration to the open-side cable 22*a*, and it is possible to effectively prevent the "irregular shape of winding" described above from being generated.

First, the diameter dimension (R1×2) of the cross-sectional surface of the pulley groove 50 is set to a dimension larger than the diameter dimension φX of the open-side cable 22*a* ((R1×2)>φX). However, in a case where the diameter dimension (R1×2) is set to a dimension excessively larger than the diameter dimension φX, dispersion of the stress concentration to the open-side cable 22*a* becomes insufficient as well as the conventional technique, whereby there is a possibility that the "irregular shape of winding" is early generated.

On the other hand, in a case where the diameter dimension (R1×2) is set to a value close to the diameter dimension φX, an extending direction of the open-side cable 22*a* becomes parallel to the extending direction of the pulley groove 50. In other words, in a state shown in FIG. 9, the open-side cable 22*a* cannot incline with respect to the pulley groove 50. Then, the thickness dimension of the pulley 46 becomes thin, and the open-side cable 22*a* easily drops off from the pulley groove 50. In addition, the pulley 46 is prized with respect to the pulley shaft 45, whereby there is a possibility that they make smooth rotation and movement of the pulley 46 with respect to the pulley shaft 45 difficult.

Therefore, in the present embodiment, as a desirable numerical relationship between the diameter dimension (R1×2) and the diameter dimension φX, the diameter dimension (R1×2) is set to a dimension of about three times of the diameter dimension φX ((R1×2)≈φX×3).

Further, the radius dimension R2 of the connecting unit 52 and a winding length L of the open-side cable 22*a* with respect to the pulley groove 50 are set so that an inclination angle Y of a line segment AL linking the reference point P2 and the connecting point CP with respect to the reference line C becomes larger than the maximum inclination angle Z of the open-side cable 22*a* on the reference line C (Y>Z). This causes pressing force on the open-side cable 22*a* from the connecting unit 52 to be relieved.

Next, a winding procedure of the open-side cable 22*a* onto the pulley groove 50 will be described by using the drawings.

First, as shown by the dashed arrow in FIG. 6, the locking block 34 provided at the one end of the open-side cable 22*a* (see FIG. 5) is inserted to the passing path 61 of the projecting portion 60 provided in the pulley holder 41. This causes the open-side cable 22*a* to be led by the locking block 34 and inserted into the passing path 61, and the open-side cable 22*a* is elastically deformed in accordance with a circular arc shape of the projecting portion 60. Then, by pulling the open-side cable 22*a* toward the pulley 46 side, the open-side cable 22*a* is caused to pass through the slit 62. At this time, the open-side cable 22*a* is smoothly guided to the slit 62 by the taper portions 63.

Then, by further pulling the open-side cable 22*a* toward the pulley 46 side, the open-side cable 22*a* is introduced (or moved) to the pulley groove 50 via a space between the slit 62 and the connecting unit 52 as shown by an arrow (1) in FIG. 10(*a*). As shown in FIG. 8, this is because the clearance dimension W2 between the slit 62 and the connecting unit 52 is set to the dimension larger than the clearance dimension W3 between the slit 62 and the flange portion 51. Therefore, the open-side cable 22*a* never moves as a dashed arrow in FIG. 10(*a*) without necessity of visual contact with the open-side cable 22*a*.

Subsequently, as shown by an arrow (2) in FIG. 10(*b*), the open-side cable 22*a* introduced between the slit 62 and the connecting unit 52 causes the pulley 46 to be moved in the axial direction of the pulley shaft 45 (see FIG. 8) as shown by an arrow (3). Herewith, as shown by an arrow (4) in FIG. 10(*c*), the open-side cable 22*a* is wound (or arranged) in the pulley groove 50 as shown by an arrow (5), and the pulley 46 is moved in the axial direction of the pulley shaft 45, whereby the pulley 46 returns to an original state shown in FIG. 10(*a*). Thus, the winding operation of the open-side cable 22*a* onto the pulley groove 50 is completed.

Next, a situation that the open-side cable 22*a* does not drop off from the pulley groove 50 will be described by using the drawing.

When the open-side cable 22*a* is moved at high speed by the operation of the driving unit 21 (see FIG. 3), for example, as shown by an arrow (6) in FIG. 11(*a*), the open-side cable 22*a* may swell outward in the radial direction from the pulley groove 50 by means of centrifugal force against the open-side cable 22*a* or the like. Here, in a case where the pulley groove 50 faces the second connecting wall 42*d* from the radial direction, the open-side cable 22*a* can return to the pulley groove 50 immediately. On the other hand, in a case where the pulley groove 50 faces the slit 62 from the radial direction, as shown in FIG. 11(*a*), the open-side cable 22*a* may reach the passing path 61.

Even if the open-side cable 22*a* reaches the passing path 61, as shown by an arrow (7) in FIG. 11(*b*) and an arrow (8) in FIG. 11(*c*), the open-side cable 22*a* can return to the pulley groove 50 smoothly and quickly. This is because the clearance dimension W2 between the slit 62 and the connecting unit 52 is set to the dimension larger than the clearance dimension W3 between the slit 62 and the flange portion 51 (see FIG. 8) as described above. Therefore, the open-side cable 22*a* that reaches the passing path 61 never moves as any of dashed arrows in FIGS. 11(*b*) and 11(*c*).

As described above in detail, according to the driving unit 21 of the first embodiment, the cross-sectional shape of the open-side cable 22*a* is formed into the round shape, and the cross-sectional shape of the connecting unit 52 between the pulley groove 50 of the pulley 46 and the flange portion 51 is formed into the circular arc shape. Thus, it is possible to surely suppress damage of the open-side cable 22*a* caused by being strongly pressed to the corner as the conventional manner. Therefore, it is possible to improve durability of the open-side cable 22*a*, whereby it is possible to extend a maintenance cycle of the driving unit 21 and obtain high reliability.

Further, according to the driving unit 21 of the first embodiment, the cross-sectional shape of the pulley groove 50 is formed into the circular arc shape, and the radius dimension R1 of the pulley groove 50 is set to the dimension that is equal to or larger than the diameter dimension φX of the open-side cable 22*a*. Thus, the open-side cable 22*a* is allowed to carry out the swing motion around the reference point P2 inside the pulley groove 50 (see FIG. 9). This makes it possible to suppress the pulley 46 from being prized with respect to the pulley shaft 45 by means of the open-side cable 22*a*, whereby it is possible to operate the pulley 46 smoothly.

Moreover, according to the driving unit 21 of the first embodiment, the projecting portion 60 is provided on the pulley holder 41; the passing path 61 through which the locking block 34 can pass into the projecting portion 60; and the slit 62 configured to guide the winding of the open-side cable 22*a* from the passing path 61 to the pulley groove 50 is further provided inside the projecting portion 60 in the radial direction. Therefore, it is possible to easily carry out the winding operation of the open-side cable 22*a* onto the pulley groove 50 at the time of assembling of the driving unit 21. Therefore, it is possible to improve the assembly operability, and this makes it possible to enhance a yield ratio thereof.

Further, according to the driving unit 21 of the first embodiment, the width dimension W1 of the slit 62 allows passage of the open-side cable 22*a*, and is set to the dimension for controlling passage of the locking block 34. Therefore, it is possible to further improve operability to assemble the driving unit 21. Moreover, the taper portions 63 for guiding the movement of the open-side cable 22*a* from the passing path 61 to the slit 62 are formed between the passing path 61 and the slit 62. Therefore, it is possible to further improve the assembly operability of the driving unit 21.

Further, according to the driving unit 21 of the first embodiment, the projecting portion 60 is disposed at the central part of the second connecting wall 42*d* along the axial direction of the pulley shaft 45, the clearance dimension W2 between the slit 62 and the connecting unit 52 in the state where the pulley 46 comes into contact with one of the support walls 42*b* becomes the dimension larger than the clearance dimension W3 between the slit 62 and the flange portion 51. This makes it possible to carry out the winding operation of the open-side cable 22*a* onto the pulley groove 50 easily and surely at the time of assembling of the driving unit 21 (see FIG. 10). Moreover, even if the open-side cable 22*a* reaches the passing path 61 during an operation of the driving unit 21, it is possible to return the open-side cable 22*a* to the pulley groove 50 smoothly and quickly (see FIG. 11).

Second Embodiment

Next, a second embodiment according to the present invention will be described in detail by using the drawing. Note that the same reference numerals are respectively applied to portions that have the similar functions to those of the first embodiment described above, and detail description thereof is omitted.

FIG. 12 is a cross-sectional view showing a pulley periphery of a tensioner mechanism according to the second embodiment.

In the second embodiment, as shown by an arrow M3 of FIG. 12, only a point that a pulley 70 is provided swingably around a central point P3 with respect to a pulley shaft 45 is different compared with the first embodiment (see FIG. 8). Specifically, a cylindrical portion 71 formed into a cylindrical shape is provided inside the pulley 70 in a radial direction. A bearing member 72 made of resin material such as plastics is mounted inside this cylindrical portion 71 in the radial direction.

The inside of the bearing member 72 in the radial direction is fitted onto the pulley shaft 45 rotatably and movably in an axial direction. Further, an annular and circular convex surface 73 is formed outside the bearing member 72 in the radial direction. A predetermined curvature is set for the circular convex surface 73. This circular convex surface 73 is slidably brought into contact with an annular and circular concave surface 74. The circular concave surface 74 is formed inside the cylindrical portion 71 in the radial direction. Here, a predetermined gap S is formed between the cylindrical portion 71 and the pulley shaft 45. This allows the pulley 70 to swing around the central point P3 with respect to the pulley shaft 45.

In the second embodiment formed as described above, the actions and effects similar to those according to the first embodiment described above can also be achieved. In addition to this, in the second embodiment, the pulley 70 is provided swingably with respect to the pulley shaft 45. Thus, even in a case where such force that the pulley 70 is prized with respect to the pulley shaft 45 acts thereto from the open-side cable 22*a* (see FIG. 8), the pulley 70 swings so as to follow this as shown by a two-dot chain line in FIG. 12. Therefore, it is possible to operate the pulley 70 more smoothly.

Third Embodiment

Next, a third embodiment according to the present invention will be described in detail by using the drawing. Note that the same reference numerals are respectively applied to portions that have the similar functions to those of the first embodiment described above, and detail description thereof is omitted.

FIG. 13 shows a cross-sectional view corresponding to FIG. 8 that shows the tensioner mechanism according to the third embodiment.

In the third embodiment, only a cross-sectional shape of a pulley groove 80 is different compared with the first embodiment (see FIG. 8). Specifically, the pulley groove 80 is provided over the whole area of the pulley body 46*c* in a circumferential direction so as to open toward the outside of the pulley 46 in a radial direction. A pair of flat surfaces 81, which forms the pulley groove 80, is respectively connected to a pair of connecting units 52.

In the third embodiment formed as described above, the actions and effects similar to those according to the first embodiment described above can also be achieved. Here, since the open-side cable 22*a* is pressed to the pair of flat surfaces 81 (two places), it is possible to disperse stress concentration that acts on the open-side cable 22*a* to at least two places. Therefore, it is possible to suppress "irregular shape of winding" from being generated compared with a conventional manner in which the stress concentration acts on one place.

The present invention is not limited to each of the embodiments described above. It goes without saying that the present invention may be modified into various forms of applications without departing from the substance of the invention. For example, in each of the embodiments described above, the driving unit 21 is disposed inside the vehicle body 11, and each of the cables 22*a*, 22*b* is connected to the sliding door 13. However, the present invention is not limited to this structure. The present invention may have a structure in which the driving unit 21 is disposed inside the sliding door 13 and the cables 22*a*, 22*b* are fixed to both ends of the guide rail 14 via portions in the roller assembly 13*a* of the sliding door 13.

Otherwise, quality of material, a shape, a dimension, the number, an installation location, and the like of each of the components of the wiper device according to each of the embodiments described above are arbitrary so long as each of them can achieve the present invention. Further, they are not limited to those in each of the embodiments described above.

An opening-closing body driving device is used to drive a sliding door that is mounted on a side portion of a vehicle body in a vehicle and opens and closes an opening portion formed at the side portion of the vehicle body.

The invention claimed is:

1. An opening-closing body driving device configured to drive an opening-closing body for opening and closing an opening portion, the opening-closing body driving device comprising:

a case;

a drum having a spiral guide groove on an outer periphery of the drum, the drum being configured to be accommodated in the case;

a cable, one end of the cable being wound in the guide groove, the other end of the cable being connected to the opening-closing body;

a cable entrance portion provided on the case, the cable going in and out of the case from the cable entrance portion;

a pulley holder provided between the drum in the case and the cable entrance portion, the pulley holder including a pulley shaft;

a pulley provided rotatably around the pulley shaft and movably in an axial direction of the pulley shaft, the pulley including a pulley groove on which the cable is wound;

flange portions provided at both sides of the pulley in the axial direction, each of the flange portions preventing the cable to drop off from the pulley groove; and a spring member accommodated in the case, the spring member being configured to press the pulley holder in such a direction that a path length between the drum and the cable entrance portion is increased, wherein a cross-sectional shape of the cable is formed into a round shape, and a cross-sectional shape of a connecting unit between the pulley groove of the pulley and each of the flange portions is formed into a circular arc shape, wherein the pulley holder includes:

a pair of support walls that respectively supports both sides of the pulley shaft in an axial direction, and controls movement of the pulley in the axial direction;

a connecting wall disposed outside the pulley in a radial direction of the pulley to connect the pair of support walls to each other;

a projecting portion provided on the connecting wall, the projecting portion projecting outside the pulley in the radial direction;

a passing path provided inside the projecting portion to allow a locking block to pass through the passing path, the locking block being provided at one end of the cable; and a slit provided inside the projecting portion in the radial direction to guide winding of the cable from the passing path to the pulley groove, and wherein a taper portion is formed between the passing path and the slit, the taper portion being configured to guide movement of the cable from the passing path to the slit.

2. The opening-closing body driving device according to claim 1, wherein a cross-sectional shape of the pulley groove is formed into a circular arc shape, and a radius dimension of the pulley groove is a dimension is equal to or larger than a diameter dimension of the cable.

3. The opening-closing body driving device according to claim 1, wherein a width dimension of the slit is set to a dimension by which the cable is allowed to pass through the slit and controls passage of the locking block.

4. The opening-closing body driving device according to claim 1, wherein the pulley is provided so that the pulley can axially slide in the pulley shaft in response to swing of the cable.

5. An opening-closing body driving device configured to drive an opening-closing body for opening and closing an opening portion, the opening-closing body driving device comprising:

a case;

a drum having a spiral guide groove on an outer periphery of the drum, the drum being configured to be accommodated in the case;

a cable, one end of the cable being wound in the guide groove, the other end of the cable being connected to the opening-closing body;

a cable entrance portion provided on the case, the cable going in and out of the case from the cable entrance portion;

a pulley holder provided between the drum in the case and the cable entrance portion, the pulley holder including a pulley shaft;

a pulley provided rotatably around the pulley shaft and movably in an axial direction of the pulley shaft, the pulley including a pulley groove on which the cable is wound;

flange portions provided at both sides of the pulley in the axial direction, each of the flange portions preventing the cable to drop off from the pulley groove; and a spring member accommodated in the case, the spring member being configured to press the pulley holder in such a direction that a path length between the drum and the cable entrance portion is increased, wherein a cross-sectional shape of the cable is formed into a round shape, and a cross-sectional shape of a connecting unit between the pulley groove of the pulley and each of the flange portions is formed into a circular arc shape, wherein the pulley holder includes:

a pair of support walls that respectively supports both sides of the pulley shaft in an axial direction, and controls movement of the pulley in the axial direction;

a connecting wall disposed outside the pulley in a radial direction of the pulley to connect the pair of support walls to each other;

a projecting portion provided on the connecting wall, the projecting portion projecting outside the pulley in the radial direction;

a passing path provided inside the projecting portion to allow a locking block to pass through the passing path, the locking block being provided at one end of the cable; and a slit provided inside the projecting portion in the radial direction to guide winding of the cable from the passing path to the pulley groove, wherein the projecting portion is disposed at a central part of the connecting wall along the axial direction of the pulley shaft, and wherein a clearance dimension between the slit and the connecting unit is a dimension larger than a clearance dimension between the slit and the flange portion in a state where the pulley comes into contact with the support wall.

6. The opening-closing body driving device according to claim 5, wherein a cross-sectional shape of the pulley groove is formed into a circular arc shape, and a radius dimension of the pulley groove is a dimension is equal to or larger than a diameter dimension of the cable.

7. The opening-closing body driving device according to claim 5, wherein a width dimension of the slit is set to a dimension by which the cable is allowed to pass through the slit and controls passage of the locking block.

8. The opening-closing body driving device according to claim 5, wherein the pulley is provided so that the pulley can axially slide in the pulley shaft in response to swing of the cable.

* * * * *